United States Patent [19]

Lemcke

[11] 4,430,696

[45] Feb. 7, 1984

[54] LAMP MOUNTING MEANS

[75] Inventor: Ulrich Lemcke, Heidenheim, Fed. Rep. of Germany

[73] Assignee: Carl-Zeiss-Stiftung, Heidenheim, Fed. Rep. of Germany

[21] Appl. No.: 462,197

[22] Filed: Jan. 31, 1983

[30] Foreign Application Priority Data

Feb. 5, 1982 [DE] Fed. Rep. of Germany ... 8203068[U]

[51] Int. Cl.[3] ..... F21V 7/00

[52] U.S. Cl. ..... 362/306; 362/226; 362/433

[58] Field of Search ..... 362/306, 226, 433

[56] References Cited

U.S. PATENT DOCUMENTS 1,795,696 3/1931 Yaupp ..... 362/433

1,910,542 5/1933 Hendee ..... 362/433

*Primary Examiner*—Stephen J. Lechert, Jr.

*Attorney, Agent, or Firm*—Stonebraker, Shepard & Stephens

[57] ABSTRACT

For the mounting of a lamp which is firmly connected with a reflector, at least two coil springs are so arranged parallel to an attachment part that they contact the reflector on its outer side close to the outer periphery. The reflector is so developed at these points of contact that components of force perpendicular to the attachment surface are produced by the springs.

11 Claims, 6 Drawing Figures

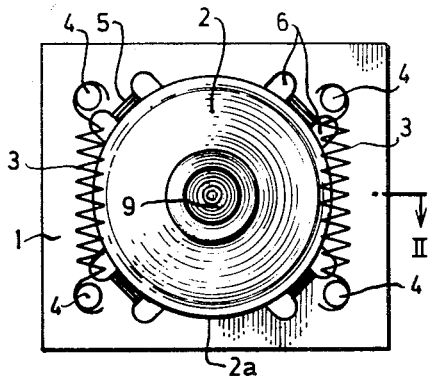
Fig.1
Fig. 4
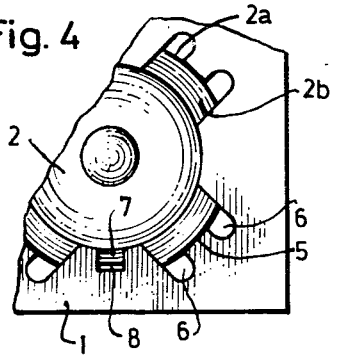
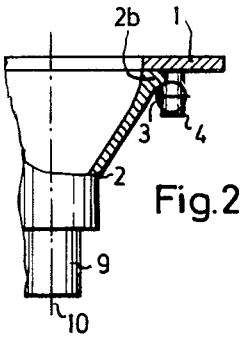
Fig.2
Fig.3a
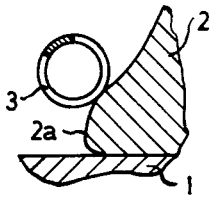
Fig.3b
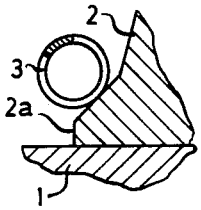
Fig.3c
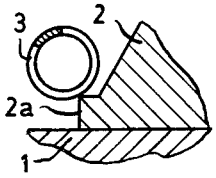

LAMP MOUNTING MEANS

BACKGROUND OF THE INVENTION

The present invention relates to a mount for a lamp, which is firmly connected with a reflector and which has springs which press the reflector against an attachment part.

Such lamp mounts are used in many optical instruments which contain an illuminating device, for instance in microscopes, particularly operation microscopes, in medical and ophthalmological instruments, in analytical instruments, etc. In the case of such instruments it is necessary that the lamp (e.g., an incandescent bulb) can be replaced as easily as possible and that, insofar as possible, no adjustment need be effected after the insertion of the new lamp. Particularly suitable for this purpose are lamp mounts or sockets which are firmly connected to a reflector, and in which the filament of the lamp has a precisely defined position with respect to the axis of the reflector and to the attachment surface to which the reflector is attached.

It is known to press such a lamp mount, together with its reflector, by means of leaf springs against a correspondingly developed attachment part. The lamp together with the reflector is capable of being taken apart of the attachment part by a tension and being capable of being combined to the attachment part by a pressure which must be applied initially in opposition to the spring force. The leaf springs then hold the reflector and the lamp firmly on the mounting part.

This known solution, however, has disadvantages. The construction of a lamp mount with leaf springs is relatively cumbersome and thus expensive. The leaf springs furthermore limit accessibility to the outside of the reflector and thus make replacement difficult. Furthermore, the leaf springs are sensitive to incorrectly applied stresses such as can easily occur if the reflector is not removed or inserted entirely correctly, for instance as a result of canting or improper positioning.

The object of the present invention is therefore to create a lamp mount which is characterized by simple construction, ease of handling upon replacement, and lack of sensitivity to improper handling.

SUMMARY OF THE INVENTION

This object is achieved in accordance with the invention in the manner that at least two coil springs are arranged parallel to the attachment part.

It is advantageous for the coil springs to be arranged at the same distance from the attachment part. Furthermore, it is advisable to arrange the coil springs with axial symmetry to the axis of the reflector. In one particularly advantageous embodiment, the attachment part is developed as a centering member for the reflector.

In another embodiment the reflector is provided with a hose or projection, and the attachment part is provided with a corresponding recess so that the reflector engages in a well-defined angular position with respect to its axis of rotation.

One advantage of the invention furthermore resides in the fact that the outside of the reflector is readily accessible, and thus removal of the reflector from the mounting surface of the attachment part for replacement of the lamp is facilitated, since the coil springs are arranged just above the mounting surface and parallel to it. Furthermore, coil springs are very cheap parts, easily available on the market, and do not have to be specially manufactured for use in the present invention.

BRIEF DESCRIPTION OF THE DRAWINGS

FIG. 1 shows an illustrative embodiment for the lamp mount with two coil springs, seen in plan view;

FIG. 2 is a fragmentary section taken along the line II of FIG. 1;

FIGS. 3*a*, 3*b*, and 3*c* are fragmentary sections illustrating alternative shapes of the edge of the reflector which comes into contact with the coil springs; and FIG. 4 shows a portion of the embodiment of FIG. 1, seen from the other side or opposite direction.

DESCRIPTION OF THE PREFERRED EMBODIMENTS

In FIGS. 1 and 2, 1 is the attachment part (of a microscope or other instrument) against which the reflector 2 is pressed by the coil springs 3. The coil springs 3 are held by the studs or posts 4 which are seated in the attachment part 1. The guides 5, which are produced, for instance, in simple fashion by bending the attachment part 1 forward between the backward recesses 6, serve for the centering of the reflector 2. As shown in FIG. 1, this bending can be effected somewhat beyond a right angle, so that a tapered or conical guide is produced for the reflector 2, which guide facilitates the insertion of the reflector, including the lamp mount which is firmly connected to it. However, the guide 5 can also form a right angle with the attachment part 1, if desired. The lamp mount 9 may be in the form of a lamp socket for receiving a lamp bulb with a screw base or a bayonet type base, or any other known form of mount.

Examples of the development of the outside rim of the reflector at those places where it is contacted by the coil springs 3 are shown on a larger scale in FIGS. 3*a*, 3*b*, and 3*c*. FIG. 3*a* shows an embodiment which is particularly advantageous for glass reflectors, while FIGS. 3*b* and 3*c* show embodiments which are particularly well suited for plastic or metal. As shown in FIG. 3*c*, the springs can also press against an edge. The important factor is that in all cases the coil springs exert a component of force perpendicular to the attachment surface 1. Furthermore, the outer edge or rim 2*a* of the reflector 2 must be developed in such a manner that the springs 3 are pressed aside by it upon the removal or insertion of the lamp.

FIG. 4 shows a portion of FIG. 1 seen from the other side of the attachment part 1. Within the back recesses 6 there can be seen the mounting surface 2*b* of the reflector 2. The outer edge 2*a* of the reflector 2 contacts the guide 5. The mounting surface 2*b* has a nose or projection 7 which is engaged into the recess 8 by the components of force of the springs 3 perpendicular to the mounting part 1. In this way a well-defined angular position with respect to its axis of rotation and one which is easy to find is established for the reflector 2, including the lamp.

Instead of two coil springs, three or more can also be used. They are then preferably arranged at the same distance from the mounting part 1 with axial symmetry relative to the axis 10 of the reflector 2; that is, they would be equally spaced circumferentially around the periphery of the reflector. In other words, in the case of three coil springs the angle between their points of contact with the reflector is 120° from each spring to the next one. With such an axially symmetrical arrangement of more than two coil springs, it is possible to dispense with the guides 5, since centering of the bulb is effected by the components of force of the springs 3 which are parallel to the mounting part 1. These components give a resultant of zero only in the central position of the reflector.

What is claimed is:

1. Lamp supporting means comprising a lamp mount, a reflector rigidly connected to said lamp mount, an attachment part, and at least two coil springs which press said reflector against said attachment part, each of said coil springs having opposite ends held at fixed points on said attachment part to maintain each spring stretched in longitudinal tension with an intermediate portion of each spring pressing against said reflector in a direction to press said reflector against said attachment part.

2. The invention defined in claim 1, wherein all of said coil springs (3) are arranged at substantially the same distance from said attachment part (1).

3. The invention defined in claim 1, wherein said coil springs (3) are arranged in axial symmetry with respect to a central axis (10) of said reflector.

4. The invention defined in claim 1, wherein said attachment part (1) is provided with guides (5) for said reflector (2).

5. The invention defined in claim 4, wherein said guides (5) form an angle greater than 90° with said attachment part (1).

6. The invention defined in claim 1, wherein said reflector (2) has a projection (7) and said attachment part (1) has a recess (8) for receiving said projection to establish a predetermined orientation of said reflector with respect to said attachment part.

7. Mounting means for detachably mounting a reflector and lamp assembly on an attachment part of an optical instrument for quick and easy demounting and remounting when a lamp bulb needs to be replaced, said mounting means comprising an attachment part with a portion of said attachment part providing a flat surface, a hollow cup-like reflector, lamp holding means in fixed position on said reflector, said reflector having a front rim adapted to be seated on said flat surface of said attachment part, said front rim having an external periphery a portion of which is flared outwardly, and a plurality of coil springs mounted on said attachment part and extending approximately tangentially with respect to said front rim of said reflector, said springs being under tension and being positioned to overlie said outwardly flared portion of said rim to produce pressure on said rim tending to seat said rim firmly on said flat surface of said attachment part.

8. The invention defined in claim 7, wherein said rim of said reflector is circular, and said coil springs engage said rim at substantially equal circumferential spacings.

9. The invention defined in claim 7, further comprising tapered guide means on said attachment part for cooperating with said rim to guide said reflector to a correct position on said attachment part while it is being replaced thereon.

10. The invention defined in claim 7, further comprising a projection on a front edge of said rim of said reflector and a recess in said attachment part for receiving said projection to insure correct orientation of said reflector relative to said attachment part when said reflector is replaced on said part.

11. The invention defined in claim 7, wherein said coil springs are so placed with respect to said rim that intermediate portions of the respective springs may be resiliently displaced in directions transverse to their respective lengths to permit removal of said reflector from and replacement on said attachment part.

* * * * *